US011903458B1

(12) United States Patent
Fildan et al.

(10) Patent No.: US 11,903,458 B1
(45) Date of Patent: Feb. 20, 2024

(54) RIVETING MULTI-DIRECTIONAL CLOSURE

(71) Applicants: Gerhard Fildan, Vienna (AT); Karl Wanzenböck, Teesdorf (AT)

(72) Inventors: Gerhard Fildan, Vienna (AT); Karl Wanzenböck, Teesdorf (AT)

(73) Assignee: DUBROSKY & TRACY PATENT SERVICE CORP., Central (HK)

( * ) Notice: Subject to any disclaimer, the term of this patent is extended or adjusted under 35 U.S.C. 154(b) by 0 days.

(21) Appl. No.: 18/082,998

(22) Filed: Dec. 16, 2022

(51) Int. Cl.
*A44B 17/00* (2006.01)
*A41F 1/00* (2006.01)

(52) U.S. Cl.
CPC ..... *A44B 17/0041* (2013.01); *A41F 1/002* (2013.01); *A44D 2203/00* (2013.01)

(58) Field of Classification Search
CPC . A41F 1/002; A44B 17/0041; A44D 2203/00; Y10T 24/32; A45C 13/1069; H01F 7/0263
See application file for complete search history.

(56) References Cited

U.S. PATENT DOCUMENTS 3,324,521 A * 6/1967 Humiston ..... A41F 1/002 24/303
3,538,557 A * 11/1970 Ichiro ..... A44B 17/0076 24/679
4,641,401 A * 2/1987 Hasegawa ..... A44B 17/0076 24/108
6,298,527 B1 * 10/2001 Fildan ..... A44B 17/0029 450/82
6,442,808 B2 * 9/2002 Fildan ..... A41F 1/006 2/265
7,752,718 B2 * 7/2010 Fisher ..... A44B 17/0035 24/114.4
8,935,835 B2 1/2015 Fildan et al.
9,101,185 B1 8/2015 Greenberg
9,839,263 B2 * 12/2017 Villa ..... A44B 17/0052
9,936,775 B2 * 4/2018 Takani ..... A44B 19/60
10,194,718 B2 * 2/2019 Raccosta ..... A44B 17/0011
(Continued)

FOREIGN PATENT DOCUMENTS

DE 20018405 U1 1/2001
EP 1488714 A1 12/2004
(Continued)

*Primary Examiner* — Robert Sandy
*Assistant Examiner* — Louis A Mercado
(74) *Attorney, Agent, or Firm* — Kintner IP, LLC; Mary Frances Ludwig

(57) ABSTRACT

A riveting multi-directional closure includes a female part releasably engagable with a male part. The female part and the male part of the closure may each be riveted to a piece of the garment or article in any orientation without adversely affecting the efficacy of the closure. Embodiments of the closure include a hybrid of plastic and metal components, and a pair of complementary magnets, providing fast, sturdy, and secure attachment to the article, as well as comfort and ease of manipulation to a user. The female part and the male part include a plate with prongs for piercing the article, and a slot ring for receiving the prongs. The closure is attachable to the article by sandwiching the article between the plate and the slot ring and riveting the prongs within the slot ring.

16 Claims, 7 Drawing Sheets

(56) References Cited

U.S. PATENT DOCUMENTS

| | | | | |
|---|---|---|---|---|
| 10,617,179 | B2 | 4/2020 | Fiedler et al. | |
| 10,681,962 | B1 | 6/2020 | Fildan et al. | |
| 2003/0005558 | A1 | 1/2003 | Wong | |
| 2012/0060330 | A1 | 3/2012 | Fildan et al. | |
| 2012/0174346 | A1 | 7/2012 | Fildan et al. | |
| 2013/0205476 | A1* | 8/2013 | Gentile | A41F 1/08 2/311 |
| 2015/0074954 | A1 | 3/2015 | Pruitt et al. | |
| 2015/0296910 | A1* | 10/2015 | Nelson | H01F 7/0263 24/303 |
| 2018/0140031 | A1 | 5/2018 | Fildan et al. | |

FOREIGN PATENT DOCUMENTS

| | | | |
|---|---|---|---|
| EP | 2301372 | A1 | 3/2011 |
| GB | 581096 | A | 10/1946 |
| WO | 2013008340 | A1 | 1/2013 |

* cited by examiner

RIVETING MULTI-DIRECTIONAL CLOSURE

CROSS REFERENCE TO RELATED APPLICATION

None

TECHNICAL FIELD

The present invention pertains generally to closures, and more particularly to a riveting multi-directional closure for securing two pieces together and a garment having the closure.

BACKGROUND OF THE INVENTION

There are many different types of closures available in the marketplace today. Depending on the intended function and specification of the closure (i.e. the force that the closure must be able to withstand, the direction of forces the closure will be subjected to, the weight of the closure, the size of the closure, the materials of the closure and the like), the correct closure must be selected for the particular application. For example, brassieres typically incorporate hook and eye type closures, trousers and shirts often incorporate through button-type closures, and infant garments typically incorporate snap-fit type closures.

Closures that are used on garments, such as blousons, anoraks, or jackets, are ideally capable of withstanding forces in any radial direction without inadvertent release of the closure. Furthermore, these closures are required to provide a secure engagement, as they are often subjected to relatively large applied forces. This second requirement often results in closures being provided that are designed to withstand forces in a limited range of directions, as these types of closures are better suited to withstanding higher forces. However, these types of closures can be inadvertently opened once a force is applied in the opposite or different direction to the normally-applied force. Therefore, there is often a trade-off between the level of separation force that can be resisted and the direction of separation forces that can be effectively resisted.

In addition to the foregoing, if omni-directional closures are not used, these closures increase the cost and time to manufacture the item, as the closures will have to be carefully aligned on the item before being connected to the item by stitching or welding. Finally, if omni-directional closures are not used, these closures are often much harder to align and manipulate than the omni-directional closures. This renders them unsuitable for certain applications, including those for young children and those with dexterity problems.

Metal snaps, press buttons, or "Jersey" buttons may include a prong ring having about four to six prongs for riveting the closure to lightweight fabrics. This type of fastener is prone to disengage under application of radial forces or tilt between the closure components.

There is a need in the art for a closure that overcomes at least some of the above-identified problems. In particular, there is a need for a closure that is capable of withstanding relatively high separating forces in all radial directions that is also simple to manipulate. There is a further need for such a closure to be attachable to a garment or article in a way that does not require careful alignment of parts of the closure with the garment.

BRIEF SUMMARY OF THE EMBODIMENTS

Embodiments disclosed herein are directed to a riveting multi-directional closure that may be used on garments, such as jackets, anoraks, or blousons. The riveting multi-directional closure includes a snap-action mechanism for engagement of a female part and a male part in the axial direction, and is capable of withstanding separating forces in all radial directions. The male part and the female part of the closure may each be riveted to a piece of the garment or article in any orientation during manufacture without adversely affecting the efficacy of the closure. This feature facilitates and increases the manufacturing speed of garments or items including the closure. Structural aspects of the closure enable a hybrid plastic-metal fastener, where, for example, riveting components are formed of metal and releasably engagable components (e.g., components for manipulation by a user of the garment or item) are formed of plastic. Embodiments include a female magnet and a complementary male magnet, which improves ease of fastening and unfastening the closure, and is especially beneficial for children and users for whom operating a closure may be physically challenging.

According to one or more embodiments, a closure is configured for securing a first piece and a second piece together. The closure includes:

- a female part including:
  - a female body defining a seat cavity having an entrance and an opposing base;
  - a female plate having a plurality of prongs, the female plate configured for engagement with the female body;
  - a female magnet adjacent the base of the seat cavity; and
  - a female slot ring having a circumferential slot shaped and dimensioned to receive the plurality of prongs of the female plate; and
  - wherein the plurality of prongs of the female plate and the circumferential slot of the female slot ring are structurally configured for engagement with the first piece sandwiched between the female plate and the female slot ring;
- a male part including:
  - a male body including a main protuberance having a head;
  - a male plate having a plurality of prongs, the male plate configured for engagement with the male body;
  - a male magnet adjacent the head of the main protuberance and configured for releasable engagement of the female magnet; and
  - a male slot ring having a circumferential slot shaped and dimensioned to receive the plurality of prongs of the male plate; and
  - wherein the plurality of prongs of the male plate and the circumferential slot of the male slot ring are structurally configured for engagement with the second piece sandwiched between the male plate and the male slot ring; and
- wherein the main protuberance of the male part is releasably engagable with the seat cavity of the female part to secure the first piece and the second piece together.

According to one or more embodiments, the female body includes a plurality of clips extending away from the seat cavity, and the plurality of clips are shaped and arranged to hold the female plate. This feature permits rapid and secure engagement of female plate with the female body, and allows a relatively thin assembly of the female part.

According to one or more embodiments, the male body includes a plurality of clips extending away from the head of the main protuberance, and the plurality of clips are shaped and arranged to hold the male plate. This feature permits rapid and secure engagement of male plate with the male body, and allows a relatively thin assembly of the male part.

According to one or more embodiments, the female body includes a plurality of knobs extending away from the seat cavity, and the female plate includes a plurality of apertures shaped and dimensioned to receive the plurality of knobs therethrough. This feature permits secure engagement of a metal female plate with a plastic female body, such as by ultrasonic welding of the knobs. This feature also allows a relatively thin assembly of the female part.

According to one or more embodiments, the male body includes a plurality of knobs extending away from the head of the main protuberance, and the male plate includes a plurality of apertures shaped and dimensioned to receive the plurality of knobs therethrough. This feature permits secure engagement of a metal male plate with a plastic male body, such as by ultrasonic welding of the knobs. This feature also allows a relatively thin assembly of the male part.

According to one or more embodiments, the female part includes a backing plate configured to retain the female plate in engagement with the female body. According to one or more embodiments, the male part includes a backing plate configured to retain the male plate in engagement with the male body. In embodiments having either or both of these features the backing plate may be formed of plastic and may be ultrasonically welded to the male body or the female body. These features allow a straightforward method of engaging the female or male plate with the respective female or male body.

According to one or more embodiments, the female plate forms the base of the seat cavity. This feature allows a reduction in thickness of the female body, as compared to a female body having an integral base.

According to one or more embodiments, the female slot ring defines a magnet cavity. In some embodiments, the female magnet is retained between the female plate and the female slot ring. These features provides a secure housing for the female magnet and enables relatively fast assembly of the female part.

According to one or more embodiments, the male plate forms a base of the main protuberance. This feature allows a reduction in thickness of the male body, as compared to a male body having an integral base.

According to one or more embodiments, the male magnet is retained between the male body and the male plate. This features provides a secure housing for the male magnet and enables relatively fast assembly of the male part.

According to one or more embodiments, the female plate and the male plate each include from two to eight prongs. The number of prongs desired may be selected based on the material and intended use of the article to which the closure will be riveted.

These and other aspects of the embodiments will be better appreciated and understood when considered in conjunction with the following description and the accompanying drawings. The following description, while indicating various embodiments and details thereof, is given by way of illustration and not of limitation. Many substitutions, modifications, additions, or rearrangements may be made within the scope of the embodiments, and the embodiments may include all such substitutions, modifications, additions, or rearrangements.

BRIEF DESCRIPTION OF THE DRAWINGS

Non-limiting and non-exhaustive embodiments of the riveting multi-directional closure are described with reference to the following figures, wherein like reference numerals refer to like parts throughout the various views unless otherwise specified.

Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments. Also, common but well-understood elements that are useful or necessary in a commercially feasible embodiment are often not depicted in order to facilitate a less obstructed view of these various embodiments.

DETAILED DESCRIPTION OF THE INVENTION

Figure 1:
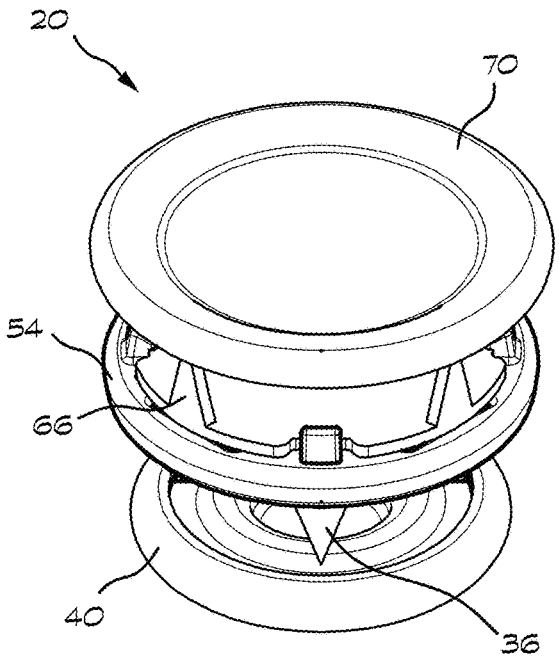
FIG. 1 is a perspective view of a riveting multi-directional closure, in accordance with a representative embodiment.
Figure 2:
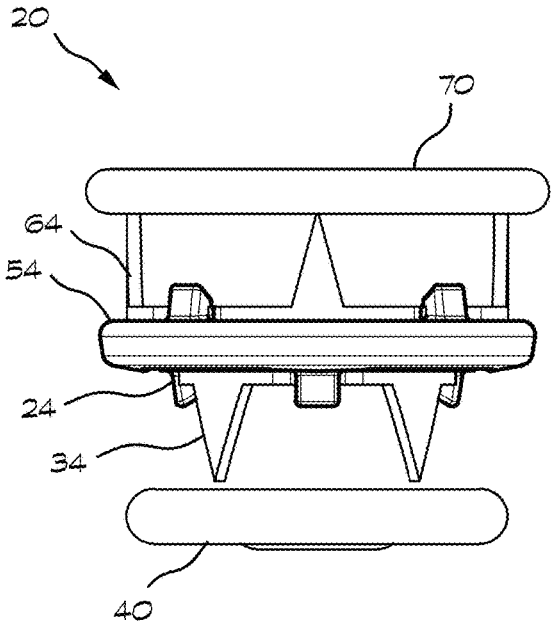
FIG. 2 is a side view of the riveting multi-directional closure, in accordance with a representative embodiment.
Figure 3:
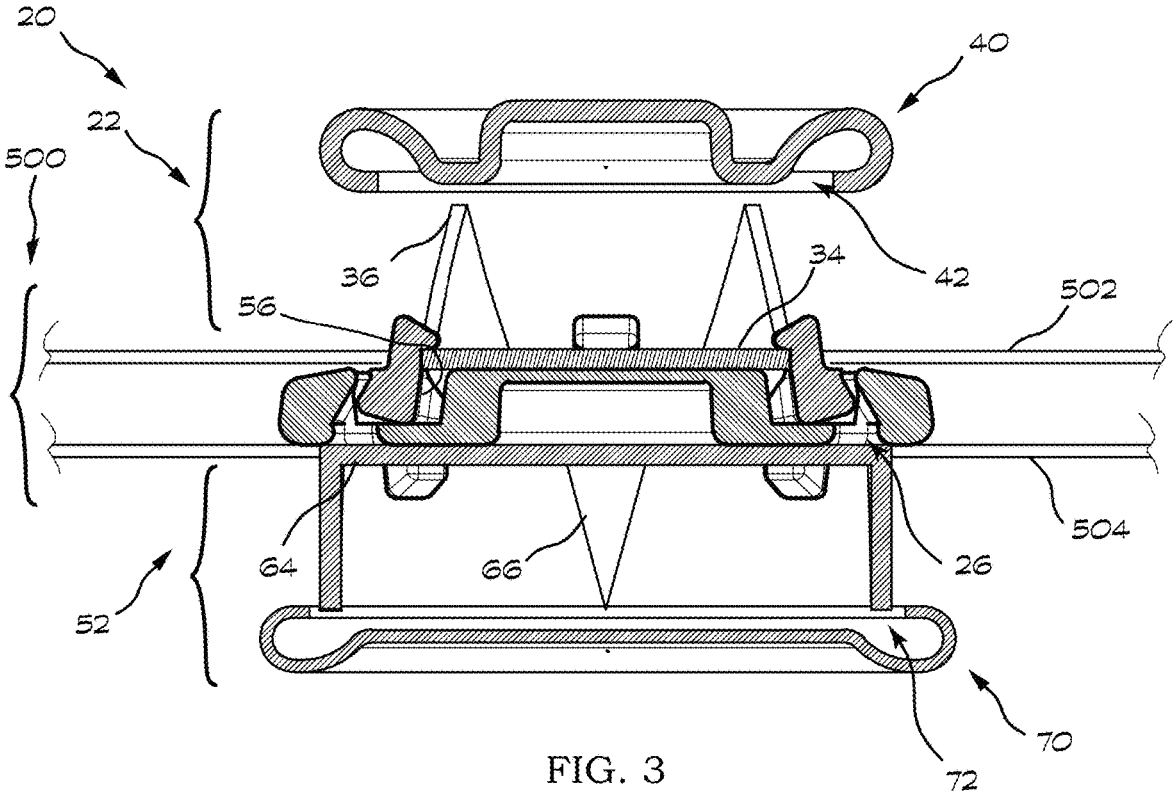
FIG. 3 is an enlarged cross-sectional view of the riveting multi-directional closure, in accordance with a representative embodiment.
Figure 4:
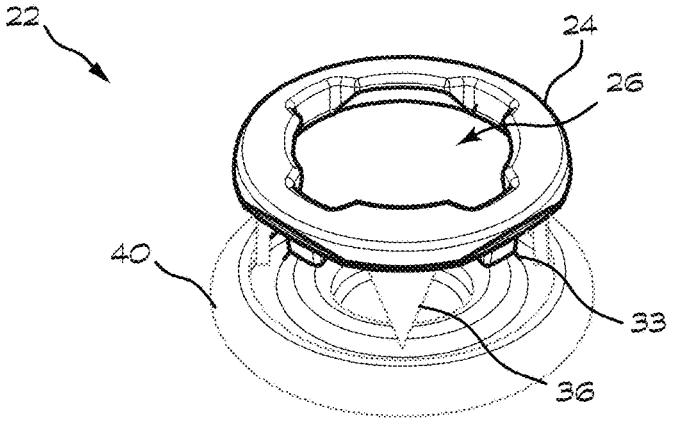
FIG. 4 is a perspective view of a female part of the riveting multi-directional closure, in accordance with a representative embodiment.
Figure 5:
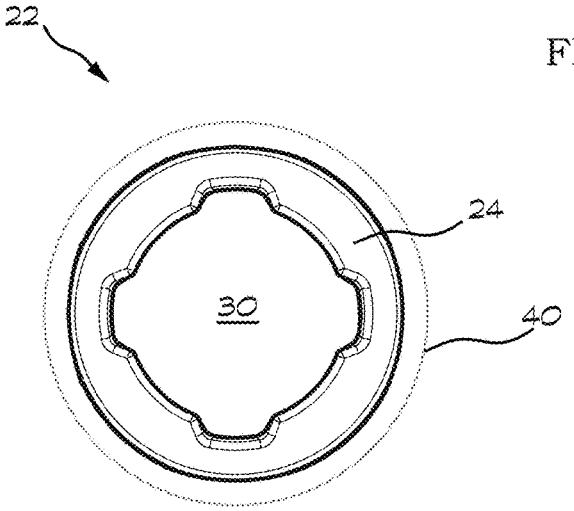
FIG. 5 is a front view of the female part, in accordance with a representative embodiment.
Figure 6:
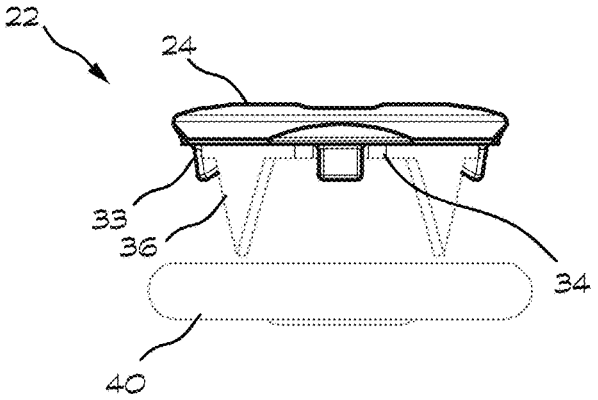
FIG. 6 is a side view of the female part, in accordance with a representative embodiment.
Figure 7:
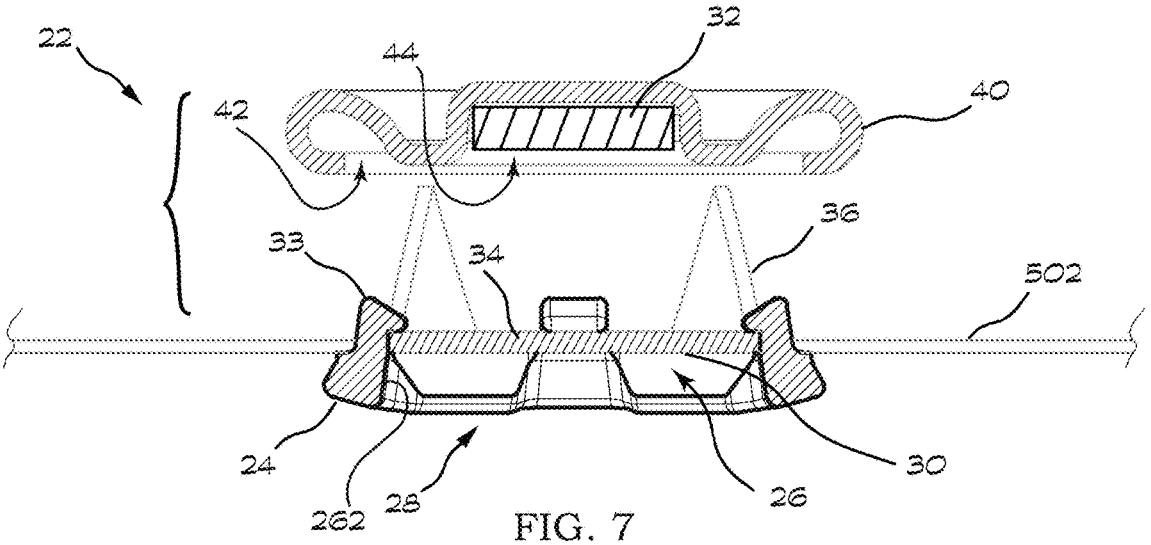
FIG. 7 is an enlarged cross-sectional view of the female part, in accordance with a representative embodiment.
Figure 8:
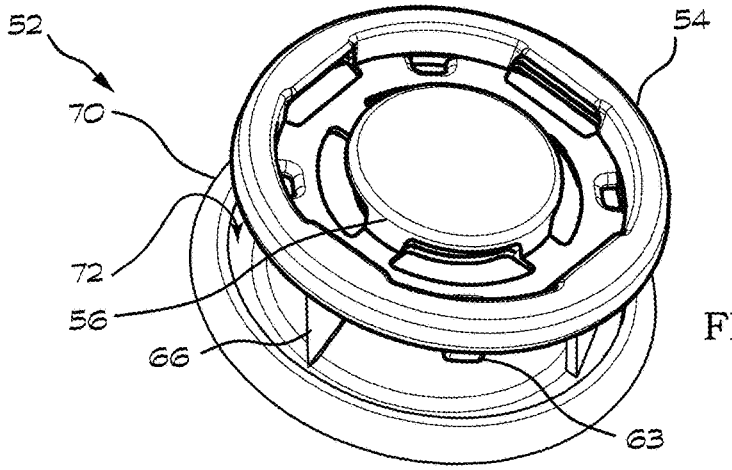
FIG. 8 is a perspective view of a male part of the riveting multi-directional closure, in accordance with a representative embodiment.
Figure 10:
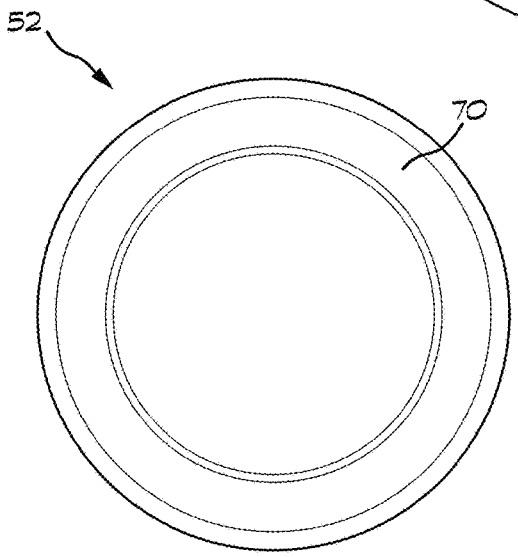
FIG. 10 is a rear view of the male part, in accordance with a representative embodiment.
Figure 9:
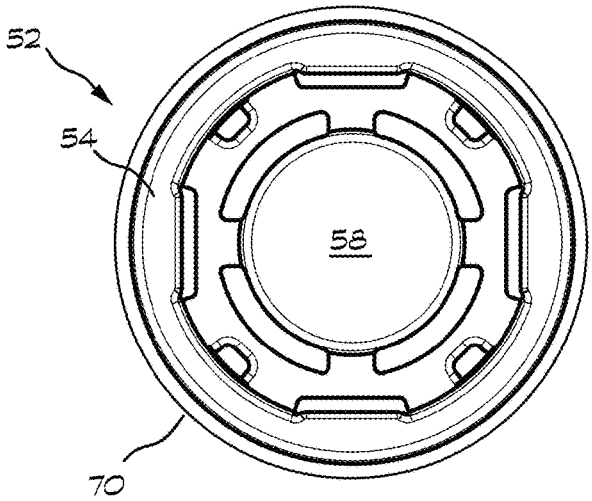
FIG. 9 is a front view of the male part, in accordance with a representative embodiment.

Referring initially to FIGS. 1-3, there are illustrated perspective, side, and enlarged cross-sectional views, respectively, of a riveting multi-directional closure, the closure generally designated as 20. Closure 20 is structurally configured for securing a first piece 502 and a second piece 504 together, where first piece 502 and second piece 504 may be pieces of a garment 500, a bag, an article formed from a textile, or similar. Closure 20 includes a female part 22 which has a seat cavity 26. Closure 20 also includes a male part 52 which has a main protuberance 56. Main protuberance 56 of male part 52 is releasably engageable with seat cavity 26 of female part 22 to secure first piece 502 and second piece 504 together (e.g., with a snap-action type of fitting).

Female part 22 and male part 52 each include a plate having a plurality of prongs and a corresponding slot ring structurally configured to receive the plurality of prongs of the plate. By sandwiching a piece (e.g., a piece of fabric such as first piece 502 or second piece 504) between the plate of the female or male part and the corresponding slot ring, and engaging the prongs with the slot ring, the female or male part may be riveted to the piece (see also riveted portions shown in hidden lines of FIG. 22). More specifically, female part 22 may include a female plate 34 having a plurality of prongs 36. A female slot ring 40 may have a circumferential slot 42 shaped and dimensioned to receive the plurality of prongs 36 of the female plate 34. Similarly, male part 52 may include a male plate 64 having a plurality of prongs 66. A male slot ring 70 may have a circumferential slot 72 shaped and dimensioned to receive the plurality of prongs 66 of the male plate 64.

Figure 11:
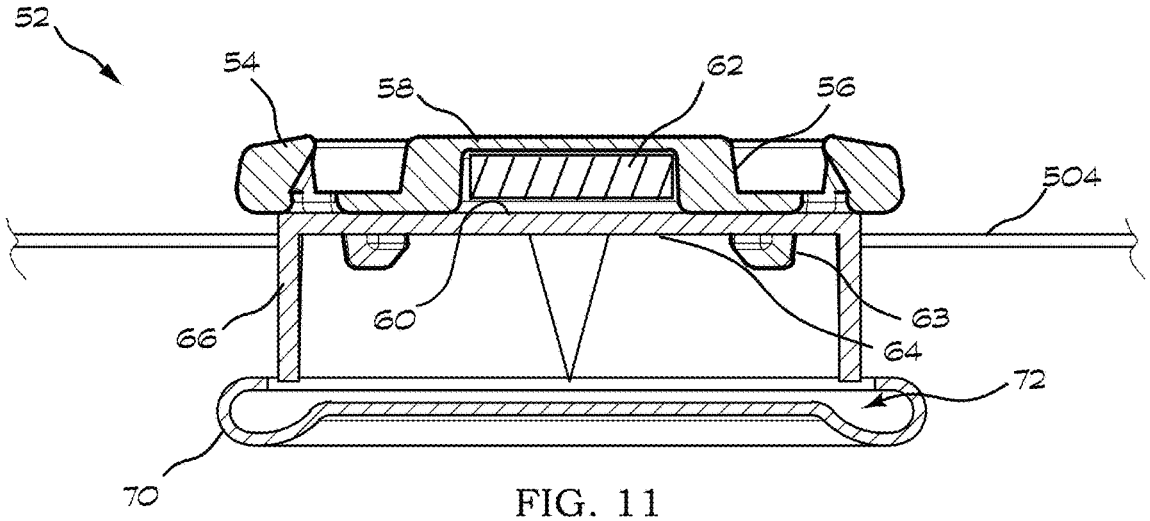
FIG. 11 is an enlarged cross-sectional view of the male part, in accordance with a representative embodiment.

FIGS. 4-7 are perspective, front, side, and enlarged cross-sectional views, respectively, of the female part 22, in accordance with a representative embodiment. As used herein, the "front" of the female part or the male part generally describes the face configured for engagement with the other of the male part or the female part of the closure; in other words, when the closure is closed the front of the female part and the front of the male part are engaged with one another and substantially hidden from view. Female part 22 includes a female body 24 which defines a seat cavity 26. Seat cavity 26 includes an entrance 28 and an opposing base 30. A female magnet 32 is housed within female body 24, adjacent base 30 of seat cavity 26. Female part 22 may be held in engagement with male part 52 at least in part by the attractive forces of female magnet 32 and male magnet 62 (see FIG. 11). It will also be appreciated also that female magnet 32 and male magnet 62 may have a self-centering effect that will facilitate the insertion of main protuberance 56 of the male part 52 into seat cavity 26 of female part 22, as described in U.S. Pat. No. 10,681,962, which is incorporated herein by reference.

Female plate 34 is structurally configured for engagement with female body 24. For example, in the shown embodiment, female body 24 includes a plurality of clips 33 extending rearwardly away from seat cavity 26. Clips 33 are shaped and arranged to hold female plate 34 in engagement with female body 24. Female plate 34 may, for example, be pressed into engagement with female body 24, and may be retained within female body 24 by one or more clips 33, a sidewall 262 of seat cavity 26, or both. In some cases, female plate 34 may form base 30 of seat cavity 26. Clips 33, sidewall 262, or both may resiliently deform to receive female plate 34.

In some embodiments, female slot ring 40 may define a magnet cavity 44. Magnet cavity 44 may be sized and shaped to house female magnet 32. For example, when female plate 34 is riveted to female slot ring 40, female magnet 32 may be enclosed within magnet cavity 44 and retained between female plate 34 and female slot ring 40.

In the shown embodiment, female plate 34 includes four prongs 36. In other embodiments, the female plate may include any number from two prongs to eight prongs.

In a preferred embodiment, female body 24 may be formed of a plastic material, such as polyoxymethylene (POM), while female plate 34 and female slot ring 40 may each be formed of a metal material, such as brass.

FIGS. 8-11 are perspective, front, rear, and enlarged cross-sectional views, respectively, of the male part 52, in accordance with a representative embodiment. Male part 52 includes a male body 54 including a main protuberance 56 having a head 58. Head 58 of main protuberance 56 is shaped and dimensioned for insertion into seat cavity 26 (see FIG. 3). A male magnet 62 is located adjacent head 58 of main protuberance 56. Male magnet 62 is configured for releasable engagement of female magnet 32, as discussed above. In embodiments, male magnet 62 may be retained between male body 54 and male plate 64.

Male plate 64 is structurally configured for engagement with male body 54. For example, in the shown embodiment, male body 54 includes a plurality of clips 63 extending rearwardly away from main protuberance 56 (e.g., in a direction opposite head 58). Clips 63 are shaped and arranged to hold male plate 64 in engagement with male body 54. Male plate 64 may, for example, be pressed into engagement with male body 54, and may be retained within male body 54 by one or more clips 63. Clips 63 may resiliently deform to receive male plate 64. In some cases, male plate 64 may form a base 60 of main protuberance 56.

In the shown embodiment, male plate 64 includes four prongs 66. In other embodiments, the male plate may include any number of prongs from two prongs to eight prongs.

In a preferred embodiment, male body 54 may be formed of a plastic material, such as polyoxymethylene (POM), while male plate 64 and male slot ring 70 may each be formed of a metal material, such as brass.

Figure 12:
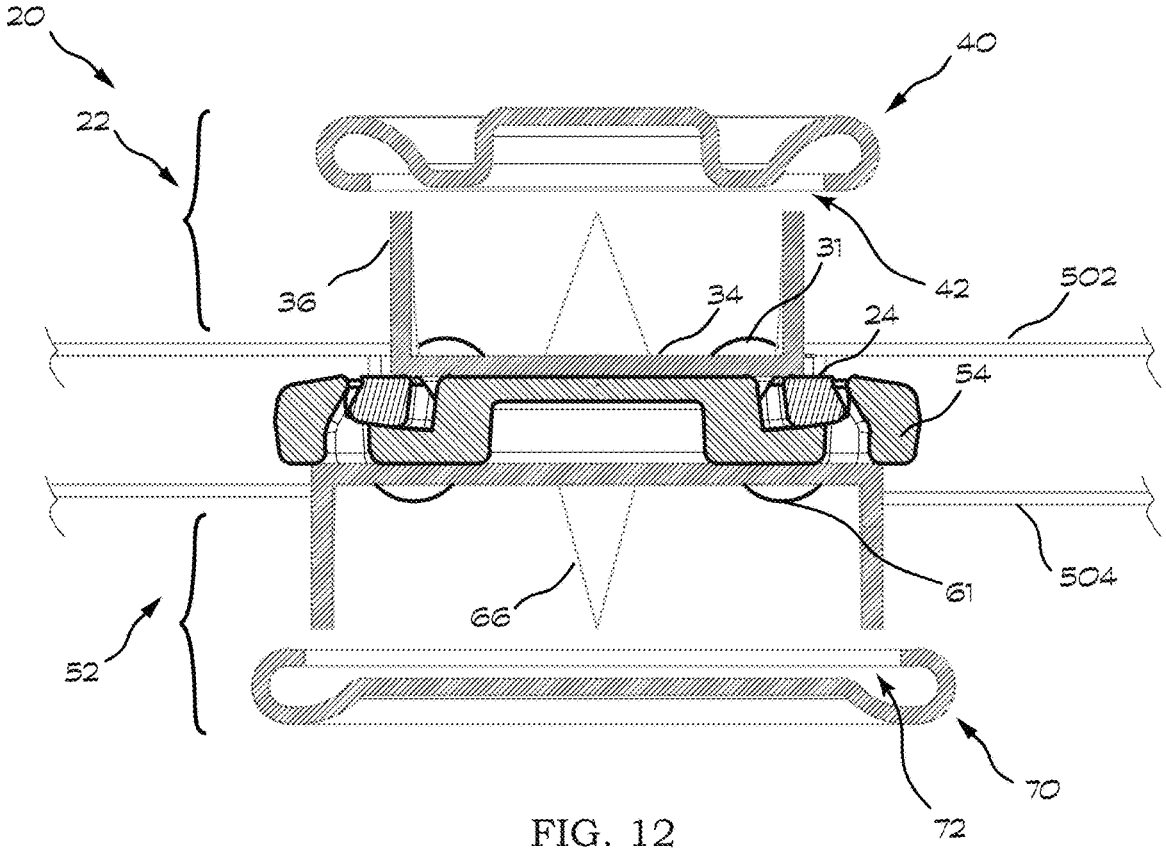
FIG. 12 is an enlarged cross-sectional view of the riveting multi-directional closure, in accordance with another representative embodiment.

FIG. 12 is an enlarged cross-sectional view another embodiment of the riveting multi-directional closure. In the shown embodiment, female plate 34 is held in engagement with female body 24 by a plurality of knobs 31 of the female body being inserted through a plurality of apertures of the female plate, and the knobs being subsequently riveted (indicated by the rounded surface of knobs 31) to retain the female plate. Similarly, male plate 64 is shown in engagement with male body 54 by a plurality of knobs 61 of the male body being inserted through a plurality of apertures of the male plate and subsequently riveted to retain the male plate. Knobs 31 or 61 may be riveted, for example, using ultrasonic welding, the application of heat, or similar methods. In other embodiments, either one of the female plate or the male plate may be retained in this manner, while the other of the female plate or the male plate may be retained within the closure in another way. Other elements of closure 20 may be similar to those described herein with reference to other embodiments (e.g., FIGS. 1-3).

Figure 14:
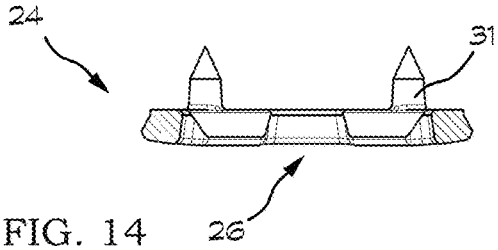
FIG. 14 is a cross-sectional view of the female body, taken along line XIV-XIV of FIG. 13.
Figure 13:
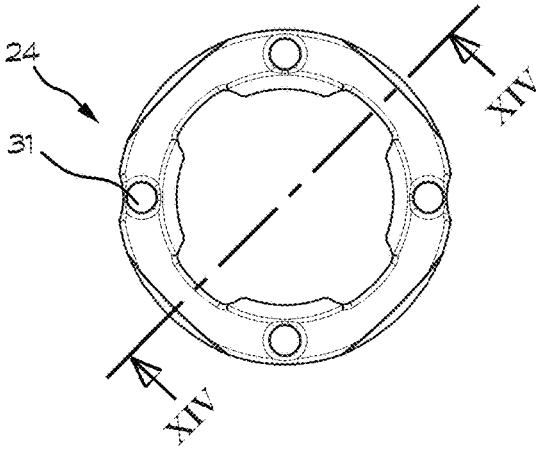
FIG. 13 is a rear view of a female body, in accordance with a representative embodiment.

FIG. 13 is a rear view of female body 24, and FIG. 14 is a cross-sectional view taken along line XIV-XIV of FIG. 13. Female body 24 is structurally configured to engage with the female plate as described with reference to FIG. 12. Female body 24 includes a plurality of knobs 31 (four knobs are present in the shown embodiment, although more or fewer knobs may be used to achieve a similar result). Knobs 31 protrude from the rear of female body 24, extending away from seat cavity 26.

Figure 16:
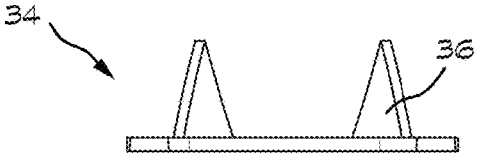
FIG. 16 is a cross-sectional view of the female plate, taken along line XVI-XVI of FIG. 15.
Figure 15:
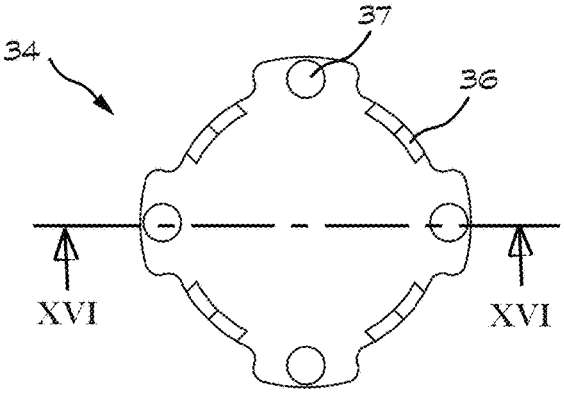
FIG. 15 is a rear view of a female plate, in accordance with a representative embodiment.

FIG. 15 is a rear view of female plate 34, and FIG. 16 is a cross-sectional view taken along line XVI-XVI of FIG. 15. Female plate 34 includes a plurality of apertures 37. Apertures 37 are each shaped and dimensioned to receive one of knobs 31 therethrough, and dimensioned so that the riveted end of the received knob 31 cannot pass back through the aperture. Four of aperture 37 are present in the shown embodiment, however it will be understood that the number of apertures 37 is preferably the same as the number of knobs 31.

Figure 17:
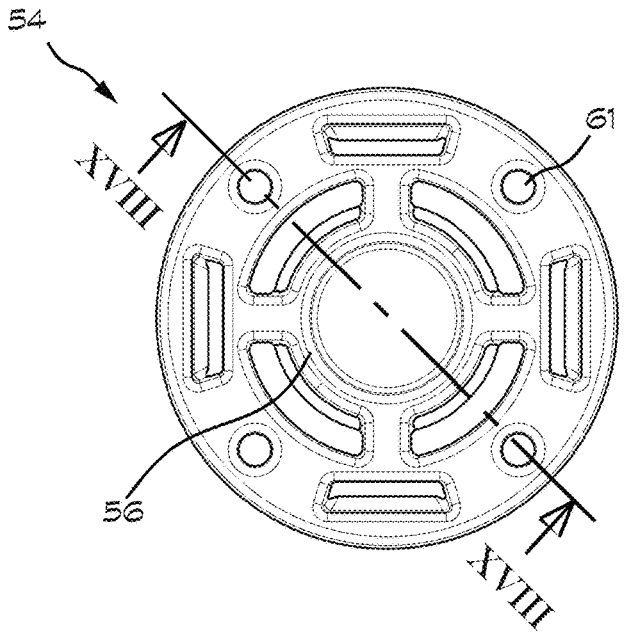
FIG. 17 is a rear view of a male body, in accordance with a representative embodiment.
Figure 18:
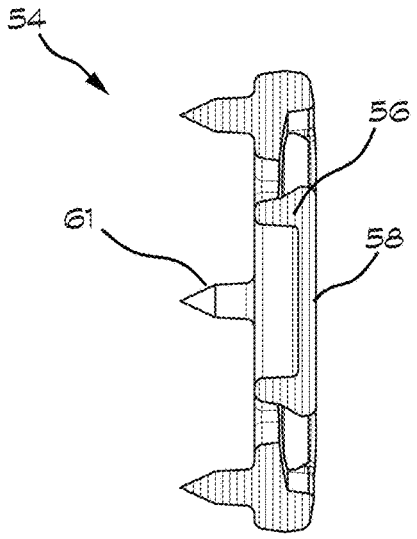
FIG. 18 is a cross-sectional view of the male body, taken along line XVIII-XVIII of FIG. 17.

FIG. 17 is a rear view of male body 54, and FIG. 18 is a cross-sectional view taken along line XVIII-XVIII of FIG. 17. Male body 54 is structurally configured to engage with the male plate as described with reference to FIG. 12. Male body 54 includes a plurality of knobs 61 (four knobs are present in the shown embodiment, although more or fewer knobs may be used to achieve a similar result). Knobs 61 protrude from the rear of male body 54, extending away from head 58 of main protuberance 56.

Figure 19:
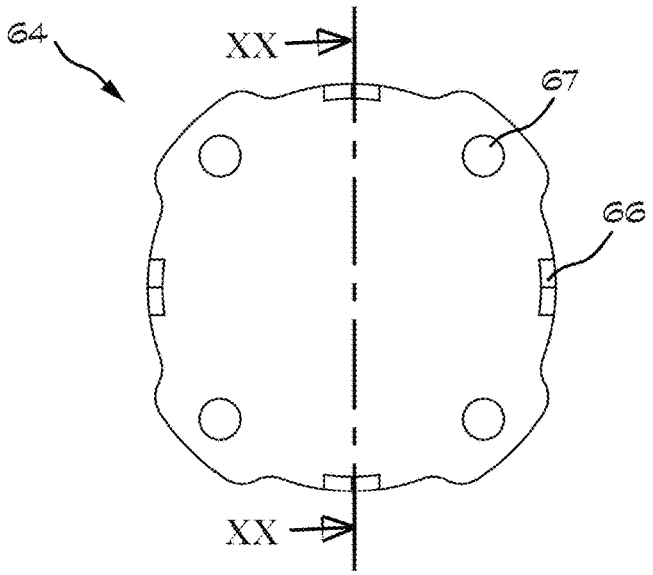
FIG. 19 is a rear view of a male plate, in accordance with a representative embodiment.
Figure 20:
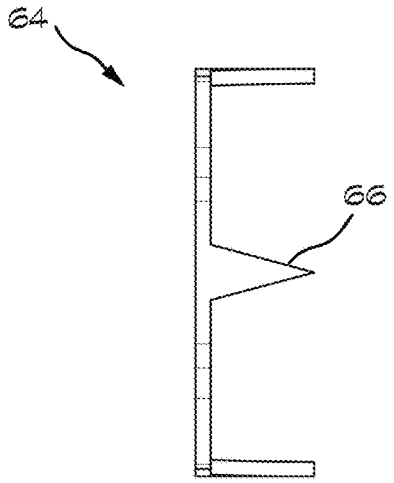
FIG. 20 is a cross-sectional view of the male plate, taken along line XX-XX of FIG. 19.

FIG. 19 is a rear view of male plate 64, and FIG. 20 is a cross-sectional view taken along line XX-XX of FIG. 19. Male plate 64 includes a plurality of apertures 67. Apertures 67 are each shaped and dimensioned to receive one of knobs 61 therethrough, and dimensioned so that the riveted end of the received knob 61 cannot pass back through the aperture. Four of aperture 67 are present in the shown embodiment, however it will be understood that the number of apertures 67 is preferably the same as the number of knobs 61.

Figure 21:
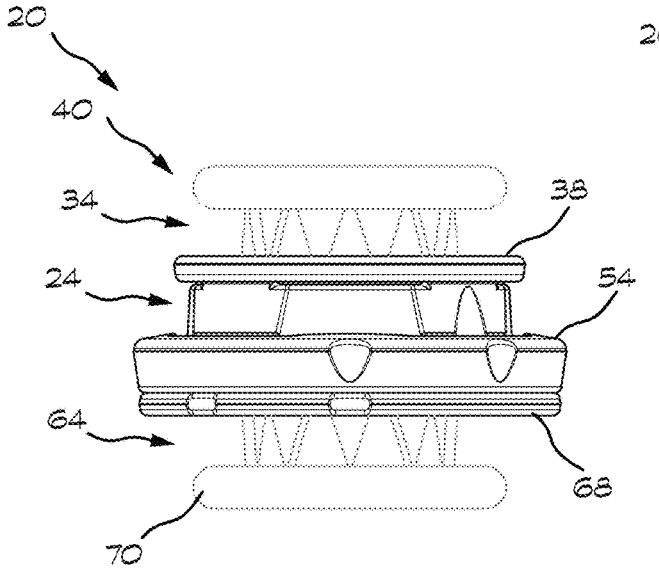
FIG. 21 is a side view of the riveting multi-directional closure, in accordance with another representative embodiment.
Figure 22:
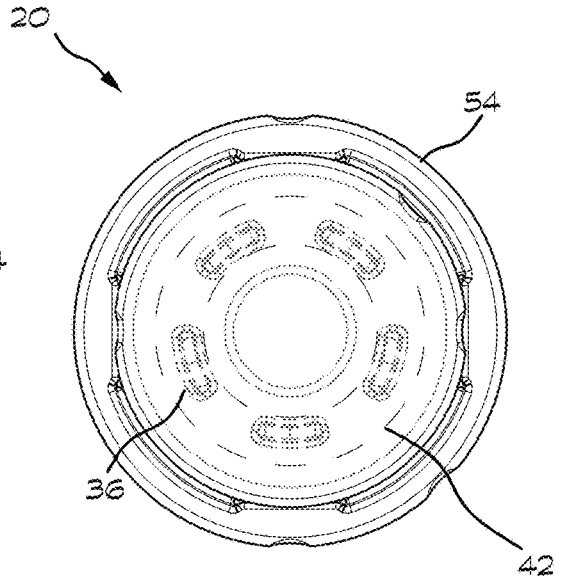
FIG. 22 is a rear view of the riveting multi-directional closure, in accordance with another representative embodiment.
Figure 23:
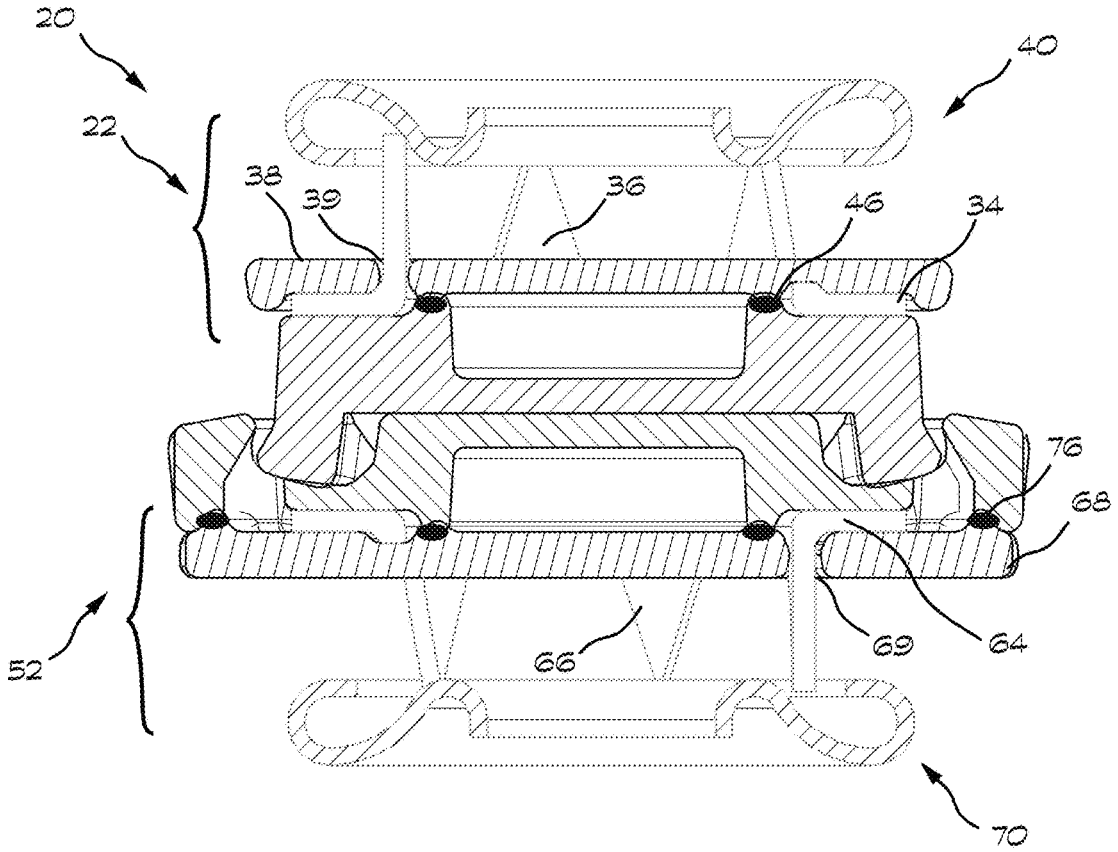
FIG. 23 is an enlarged cross-sectional view of the riveting multi-directional closure, in accordance with another representative embodiment.

FIGS. 21-23 are side, rear, and enlarged cross-sectional views, respectively, of another embodiment of the riveting multi-directional closure. In the shown embodiment, female part 22 includes a backing plate 38 configured to retain female plate 34 in engagement with female body 24. Backing plate 38 includes slots 39 shaped and dimensioned to allow prongs 36 to pass therethrough (five prongs are present in the shown embodiment). Female plate 34 may be positioned between female body 24 and backing plate 38, with prongs 36 passed through slots 39. Female body 24 and backing plate 38 may be joined together (for example, by ultrasonic welding) with female plate 34 sandwiched therebetween (see, e.g., weld regions 46 of FIG. 23). Prongs 36 may penetrate a piece of fabric or the like, and female slot ring 40 may be riveted to female plate 34 with the piece of fabric sandwiched therebetween as described herein. Weld regions 46 may also function to prevent water from contacting the magnet, thereby preventing rust or oxidization.

Male part 52 may also include a backing plate 68 configured to retain male plate 64 in engagement with male body 54 in a manner similar to that described for backing plate 38 of female part 22. Backing plate 68 includes slots 69 shaped and dimensioned to allow prongs 66 of male plate 64 to pass therethrough (five prongs are present in the shown embodiment). Male plate 64 may be positioned between male body 54 and backing plate 68, with prongs 66 passed through slots 69. Male body 54 and backing plate 68 may be joined together (for example, by ultrasonic welding) with male plate 64 sandwiched therebetween (see weld regions 76 of FIG. 23). Prongs 66 may penetrate a piece of fabric or the like, and male slot ring 70 may be riveted to male plate 64 with the piece of fabric sandwiched therebetween as described herein.

FIG. 22 also shows in hidden (dashed) lines a schematic view of prongs 36 in after being riveted within circumferential slot 42 of female slot ring 40.

In a preferred embodiment, female body 24, backing plate 38, male body 54, and backing plate 68 may be formed of a plastic material, such as polyoxymethylene (POM). In the same embodiment, female plate 34, male plate 64, female slot ring 40, and male slot ring 70 may each be formed of a metal material, such as brass.

Figure 24:
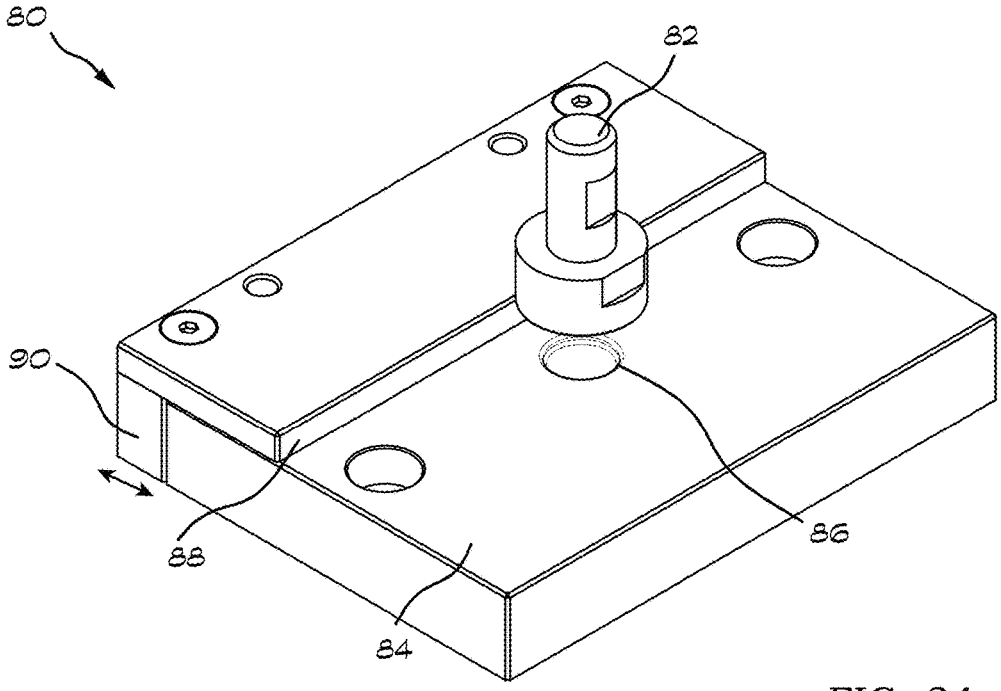
FIG. 24 is a perspective view of a system for riveting the multi-directional closure, in accordance with a representative embodiment.

FIG. 24 is a perspective view of a system 80 for riveting the multi-directional closure, in accordance with a representative embodiment. A holding device 82 is structurally configured to hold either the female body or the male body of the closure; for example, holding device 82 may include a magnet for magnetic coupling to the female magnet or the male magnet. A plate 84 may include a recess 86 structurally configured to hold either the female slot ring, the male slot ring, or both. Plate 84 may include a lip 88 that may have an adjustable offset from recess 86 (for example, bar 90 may be adjustably positionable relative to plate 84 along the directional arrow shown to adjust the offset distance of lip 88 from recess 86). Lip 88 may be used to align an edge of a piece of fabric or other material for riveting the multi-directional closure thereto at a desired distance from the edge.

Figure 25:
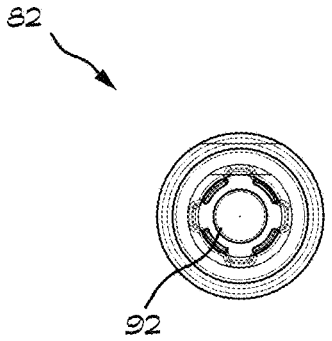
FIG. 25 is an end view of a holding device of the system for riveting the multi-directional closure, in accordance with a representative embodiment.
Figure 26:
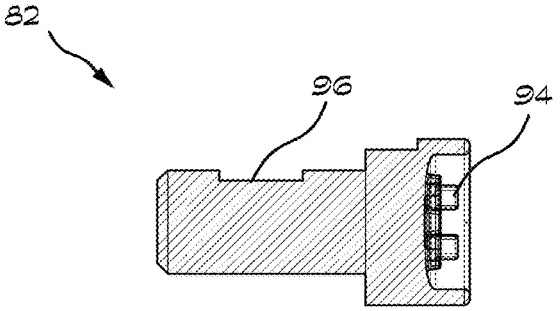
FIG. 26 is a cross-sectional view of the holding device for riveting the multi-directional closure, in accordance with a representative embodiment.

FIGS. 25-26 are end and cross-sectional views, respectively, of an exemplary holding device 82 of system 80. The shown holding device 82 is configured to hold the female body; however, it will be understood that a holding device for the male body may be, mutatis mutandis, similarly structured. Holding device 82 may include a magnet 92, one or more protrusions 94 having a shape complementary to the female body for retaining the female body without allowing rotation thereof, and/or a flat surface 96 suitable for gripping holding device 82 with pliers or a press. Holding device 82 may be formed of metal, such as brass.

In terms of use, a method for riveting a multi-directional closure to two pieces (e.g., a first piece 502 or a second piece 504) includes: (refer to FIGS. 1-26)

(a) providing a female body 24 having a seat cavity 26;
(b) engaging a female plate 34 with the female body 24;
(c) positioning a female magnet 32 adjacent a base 30 of the seat cavity 26;
(d) engaging the female body 24 with a holding device 82;
(e) positioning a female slot ring 40 in a recess 86 of a plate 84;
(f) aligning an edge of the first piece 502 to a lip 88 of riveting system 80, with the first piece overlaying recess 86;
(g) gripping the holding device 82 and pressing the holding device to the plate 84 so that the prongs 36 of the female plate 34 pierce first piece 502, protrude into the circumferential slot 42 of the female slot ring 40, and are riveted into the circumferential slot 42;

(h) providing a male body 54 having a main protuberance 56;

(i) engaging a male plate 64 with the male body 54;

(j) positioning a male magnet 62 adjacent a head 58 of the main protuberance 56;

(k) engaging the male body 54 with a holding device 82;

(l) positioning a male slot ring 70 in a recess 86 of a plate 84;

(m) aligning an edge of the second piece 504 to a lip 88 of riveting system 80, with the second piece overlaying recess 86;

(n) optionally, adjusting an offset of the lip 88 from the recess 86; and (o) gripping the holding device 82 and pressing the holding device to the plate 84 so that the prongs 66 of the male plate 64 pierce second piece 504, protrude into the circumferential slot 72 of the male slot ring 70, and are riveted into the circumferential slot 72; whereby the first piece may be secured to the second piece by releasable engagement of the main protuberance of the male part with the seat cavity of the female part.

Figure 27:
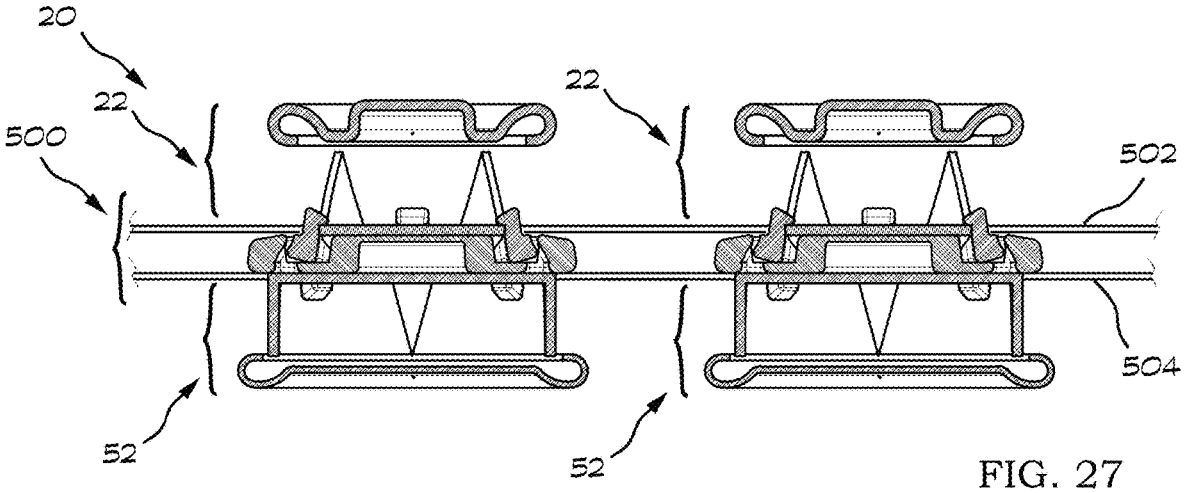
FIG. 27 is a reduced cross-sectional view of the riveting multi-directional closure, in accordance with a representative embodiment.

Further provided is a closure 20 including a plurality of female parts 22 and/or a plurality of male parts 52 (see FIG. 27). Such an embodiment may be particularly useful for providing an adjustable garment or article, such as a strap.

Further provided is a garment or an article including one or more of closure 20 according to any of the embodiments described herein.

The embodiments of the riveting multi-directional closure and methods of use described herein are exemplary and numerous modifications, combinations, variations, and rearrangements can be readily envisioned to achieve an equivalent result, all of which are intended to be embraced within the scope of the appended claims. Further, nothing in the above-provided discussions of the closure and methods should be construed as limiting the invention to a particular embodiment or combination of embodiments. The scope of the invention is defined by the appended claims.

What is claimed is:

1. A closure for securing a first piece and a second piece together, the closure comprising:

a female part comprising:

a female body defining a seat cavity having an entrance and an opposing base;

a female plate having a plurality of prongs, the female plate configured for engagement with the female body;

a female magnet adjacent the base of the seat cavity; and a female slot ring having a circumferential slot shaped and dimensioned to receive the plurality of prongs of the female plate; and wherein the plurality of prongs of the female plate and the circumferential slot of the female slot ring are structurally configured for engagement with the first piece sandwiched between the female plate and the female slot ring;

a male part comprising:

a male body including a main protuberance having a head;

a male plate having a plurality of prongs, the male plate configured for engagement with the male body;

a male magnet adjacent the head of the main protuberance and configured for releasable engagement of the female magnet; and a male slot ring having a circumferential slot shaped and dimensioned to receive the plurality of prongs of the male plate; and wherein the plurality of prongs of the male plate and the circumferential slot of the male slot ring are structurally configured for engagement with the second piece sandwiched between the male plate and the male slot ring; and wherein the main protuberance of the male part is releasably engagable with the seat cavity of the female part to secure the first piece and the second piece together.

2. The closure of claim 1, wherein the female body includes a plurality of clips extending away from the seat cavity, the plurality of clips shaped and arranged to hold the female plate.

3. The closure of claim 1, wherein the male body includes a plurality of clips extending away from the head of the main protuberance, the plurality of clips shaped and arranged to hold the male plate.

4. The closure of claim 1, wherein the female body includes a plurality of knobs extending away from the seat cavity, and the female plate includes a plurality of apertures shaped and dimensioned to receive the plurality of knobs therethrough.

5. The closure of claim 1, wherein the male body includes a plurality of knobs extending away from the head of the main protuberance, and the male plate includes a plurality of apertures shaped and dimensioned to receive the plurality of knobs therethrough.

6. The closure of claim 1, wherein the female part includes a backing plate configured to retain the female plate in engagement with the female body.

7. The closure of claim 1, wherein the male part includes a backing plate configured to retain the male plate in engagement with the male body.

8. The closure of claim 1, wherein the female plate forms the base of the seat cavity.

9. The closure of claim 1, wherein the female slot ring defines a magnet cavity.

10. The closure of claim 1, wherein the female magnet is retained between the female plate and the female slot ring.

11. The closure of claim 1, wherein the male plate forms a base of the main protuberance.

12. The closure of claim 1, wherein the male magnet is retained between the male body and the male plate.

13. The closure of claim 1, wherein the female plate and the male plate each include from two to eight prongs.

14. The closure of claim 1, further including a plurality of female parts.

15. The closure of claim 1, further including a plurality of male parts.

16. A garment including the closure of claim 1.

* * * * *